United States Patent [19]

Isobe et al.

[11] 4,120,275

[45] Oct. 17, 1978

[54] ENGINE FUEL INJECTION PUMP GOVERNOR

[75] Inventors: Hiroshi Isobe; Toru Koyanagi; Toru Sakuranaka, all of Higashi Matsuyama, Japan

[73] Assignee: Diesel Kiki Co., Ltd., Tokyo, Japan

[21] Appl. No.: 699,788

[22] Filed: Jun. 25, 1976

[30] Foreign Application Priority Data

Jun. 28, 1975 [JP] Japan ..... 50/90815[U]
Jun. 28, 1975 [JP] Japan ..... 50/90816[U]

[51] Int. Cl.[2] ..... F02D 1/04

[52] U.S. Cl. ..... 123/140 MC; 123/140 MP; 123/140 FG; 123/179 L

[58] Field of Search ..... 123/140 MC, 140 MP, 123/140 FG, 179 L

[56] References Cited

U.S. PATENT DOCUMENTS

| | | | |
|---|---|---|---|
| 2,589,788 | 3/1952 | Fell | 123/140 MC |
| 3,107,483 | 10/1963 | Hamilton | 123/140 MC |
| 3,263,662 | 8/1966 | Barth et al. | 123/140 MC |
| 3,814,072 | 6/1974 | Gillespie | 123/140 MC |
| 3,938,488 | 2/1976 | Aoki | 123/140 MC |
| 4,015,573 | 4/1977 | Okura et al. | 123/140 MC |

FOREIGN PATENT DOCUMENTS

| | | | |
|---|---|---|---|
| 2,037,235 | 2/1972 | Fed. Rep. of Germany | 123/140 MC |

*Primary Examiner*—Charles J. Myhre
*Assistant Examiner*—P. S. Lall
*Attorney, Agent, or Firm*—Mawhinney, Mawhinney & Connors

[57] ABSTRACT

A boost compensator controls the position of a fuel injection control rack in response to the induction air pressure and a centrifugal flyweight assembly increases the fuel injection volume when the engine speed is below a predetermined value. The boost compensator is provided with a releasing spring so that the control rack can be moved by the flyweight assembly independently of the boost compensator. An engine oil pressure sensor provides a maximum fuel injection volume for starting the engine when the oil pressure is zero and automatically decreases the fuel injection volume as the engine starts and the oil pressure rises to an operating value.

5 Claims, 7 Drawing Figures

ENGINE FUEL INJECTION PUMP GOVERNOR

BACKGROUND OF THE INVENTION

The present invention relates to a fuel injection pump governor for a combustion ignition engine.

The present invention overcomes two technical problems which have remained heretofore unsolved by a simple mechanical device. In a fuel injection pump governor comprising a boost compensator which positions a fuel injection control rack in response to the supercharged induction air pressure of the engine, it is necessary to provide a fuel mixture which is 120% to 150% rich for starting the engine. This function is generally provided by an operator actuated manual lever. However, many engine operators leave the lever in the start position too long, resulting in a waste of fuel and atmospheric pollution caused by the incomplete combustion of an overly rich fuel mixture.

The second problem is encountered when a centrifugal flyweight assembly is employed to increase the fuel injection volume under low speed, heavy load operation to prevent stalling of the engine. The operation of the flyweight assembly tends to oppose that of the boost compensator which results in erratic operation.

SUMMARY OF THE INVENTION

It is an object of the present invention to provide a governor for a fuel injection pump of a combustion ignition engine which comprises an engine oil pressure sensor to provide a maximum fuel injection volume for starting the engine when the oil pressure is zero and to automatically reduce the fuel injection volume as the engine starts and the oil pressure rises to an operating value.

It is another object of the present invention to provide a governor which comprises releasing means by which the action of a flyweight assembly provided to increase the fuel injection volume under low speed operating conditions automatically overrides the action of a boost compensator.

Other objects, together with the foregoing, are attained in the embodiments described in the following description and illustrated in the accompanying drawings.

DESCRIPTION OF THE PREFERRED EMBODIMENTS

While the governor of the invention is susceptible of numerous physical embodiments, depending upon the environment and requirements of use, substantial numbers of the herein shown and described embodiment have been made, tested and used, and all have performed in an eminently satisfactory manner.

Figure 1:
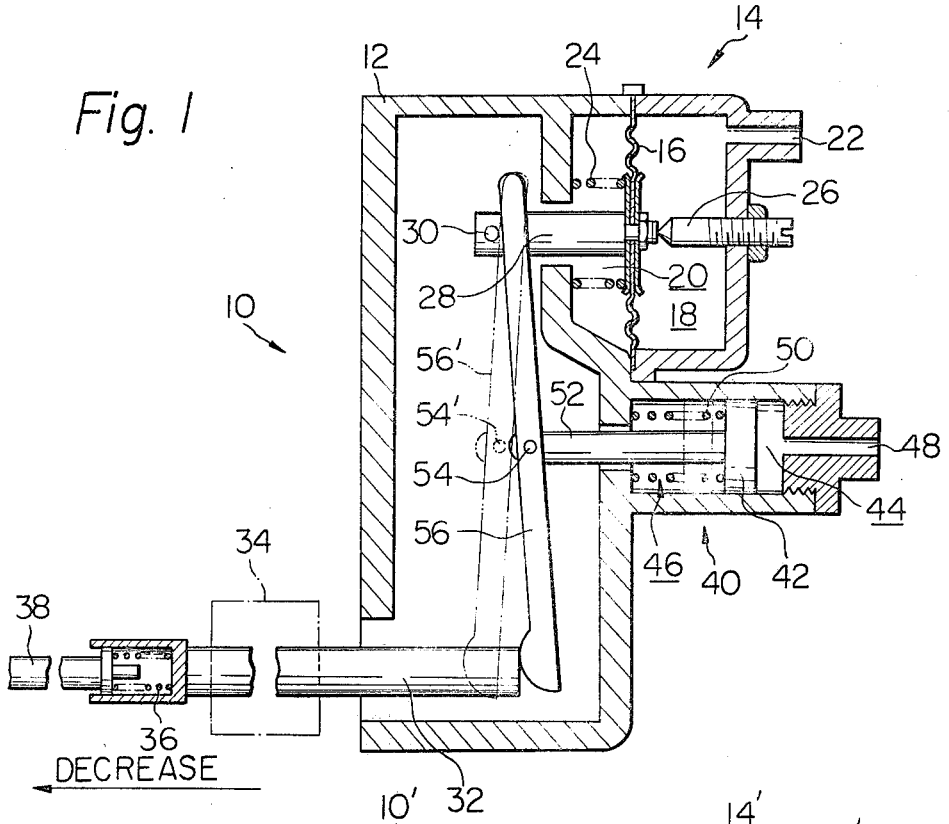
FIG. 1 is a plan view of a first embodiment of a governor according to the present invention.

Referring now to FIG. 1 of the drawings, a first embodiment of a governor 10 for a fuel injection pump of a combustion ignition engine (not shown) comprises a housing 12. A boost compensator 14 provided in the housing 12 constitutes a sensor for the supercharged induction air pressure of the engine and comprises a flexible diaphragm 16 fixed at its extremity to the housing 12 to sealingly define an induction air chamber 18 and a spring chamber 20 in the housing 12. An air inlet 22 leads into the air chamber 18 from an induction air passageway (intake manifold, etc.) of the engine and a compression diaphragm spring 24 is disposed in the spring chamber 20 urging the diaphragm 16 rightwardly against the air pressure in the air chamber 18. A stop 26 is provided in the air chamber 18 to limit rightward movement of the diaphragm 16. A rod 28 is fixed to the diaphragm 16 for unitary movement therewith and a pin 30 is fixed to the left end portion of the rod 28.

A fuel injection control member such as a rod or rack 32 is arranged to control the fuel injection volume of a fuel injection pump 34 in any known manner. The rack 32 is movable from a maximum fuel position as shown leftwardly in a fuel injection decreasing direction. A compression spring 36 is disposed between the ends of the control rack 32 and a rod 38 which is fixed in this simplified embodiment urging the control rack 32 rightwardly toward the maximum fuel injection position.

An engine oil pressure sensor 40 comprises a piston 42 which sealingly defines an oil chamber 44 and a spring chamber 46 on opposite sides thereof. An oil inlet 48 leads into the oil chamber 44 from an oil pump (not shown) of the engine, and a compression spring 50 urges the piston 42 rightwardly against the oil pressure in the oil chamber 44.

A rod 52 is fixed to the piston 42 for unitary movement and a pin 54 is fixed to the left end of the rod 52. A linkage lever 56 is pivotally supported by the pin 54 at an intermediate point thereof and is abuttingly engagable with the right end of the control rack 32 at its lower end portion. The upper end portion of the lever 56 is abuttingly engagable with the right side of the pin 30.

Figure 4:
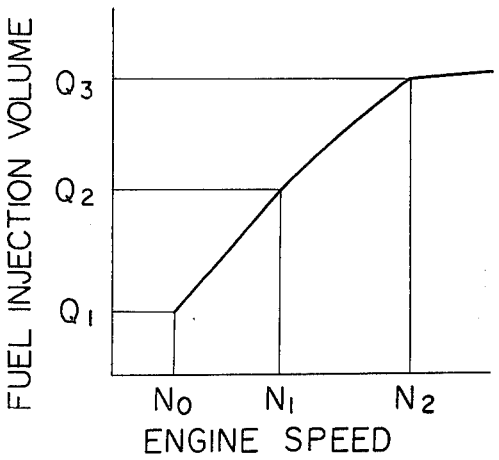
FIGS. 4 to 7 are graphs illustrating the operation of the invention.
Figure 5:
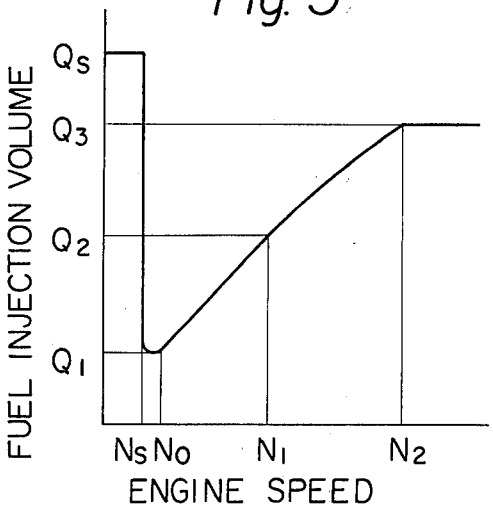

The operation of the governor 10 will now be discribed with reference to FIGS. 1, 4 and 5.

In a prior art governor which is not provided with the oil pressure sensor 40, the pin 54 would assume at all times a phantom line position designated as 54' and the lever 56 would typically be in a phantom line position 56'. Below an engine speed No in FIG. 4, the boost pressure is so low as to be weaker than the preload of the spring 24, and the spring 24 moves the diaphragm 16 rightwardly against the stop 26 so that the lever 56 is pivoted clockwise by the pin 30 thereby moving the control rack 32 leftwardly to a minimum fuel injection position. As the engine starts and the boost pressure increases, the diaphragm 16 is moved leftwardly thereby to move the control rack 32 rightwardly through the lever 56 to provide a miximum operating fuel injection volume Q3 at an engine speed N2. However, without the oil pressure sensor 40, no means are provided to increase the fuel injection volume to a value higher than Q3 to start the engine. A manual lever generally provided for this purpose in prior art governors is not shown.

With the engine oil pressure at an operating value, the governor 10 operates in the manner described above. Specifically, the oil pressure in the oil chamber 44 moves the piston 42 and rod 52 against the force of the spring 50 so that the pin 54 assumes the phantom line position 54'. However, during starting the engine when the oil pressure is substantially zero, the spring 50 moves the piston 42 and rod 52 rightwardly so that the pin 54 and lever 56 assume the solid line positions shown. The control rack 32 is in this case moved rightwardly by the spring 36 to the maximum fuel injection position as shown in FIG. 1 to provide a maximum fuel injection volume Qs in FIG. 5. The preload of the spring 50 is selected so that the oil pressure in the oil chamber 44 overcomes the preload of the spring 50 at an engine speed Ns which is slightly below the speed No. As the engine starts and the oil pump comes into operation, the rod 52 and pin 54 are again moved to the phantom line position by the piston 42 thereby automatically decreasing the fuel injection volume to an operating value as soon as the engine is started to eliminate incomplete combustion of an overly rich fuel mixture and resulting atmospheric pollution.

Figure 2:
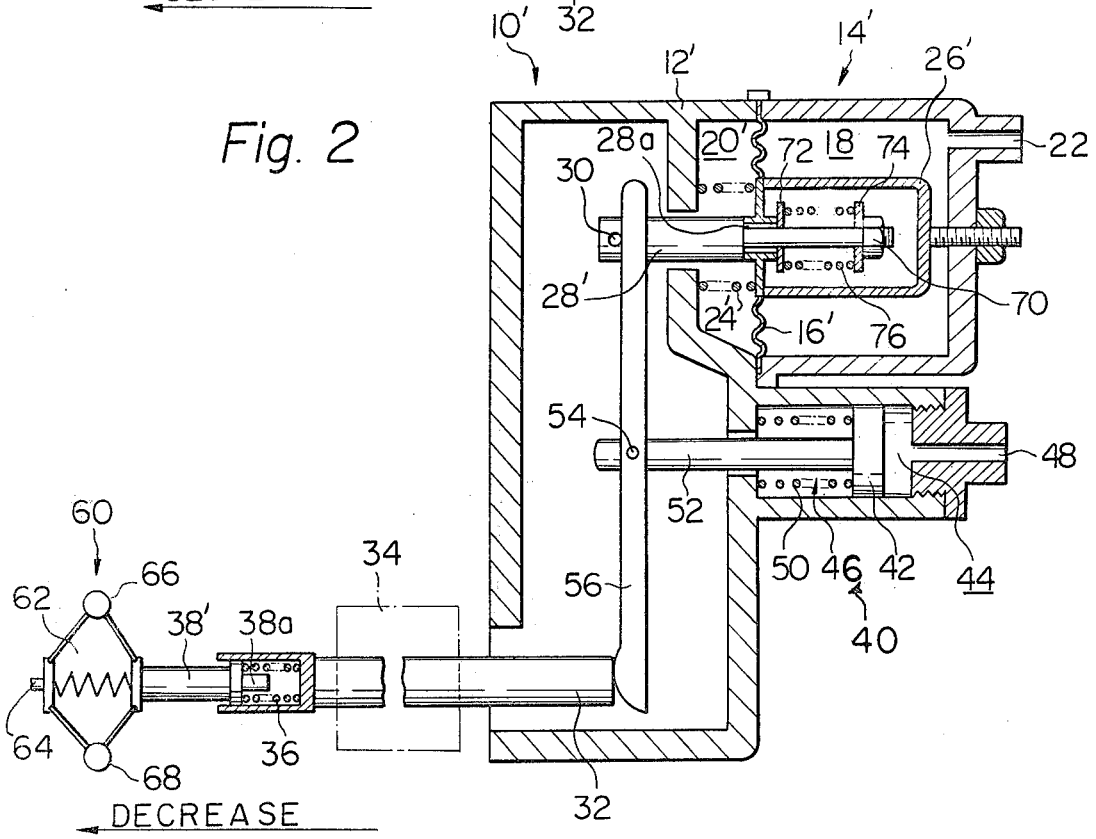
FIG. 2 is a plan view of a secnd embodiment of a governor according to the present invention under normal speed operating conditions.
Figure 3:
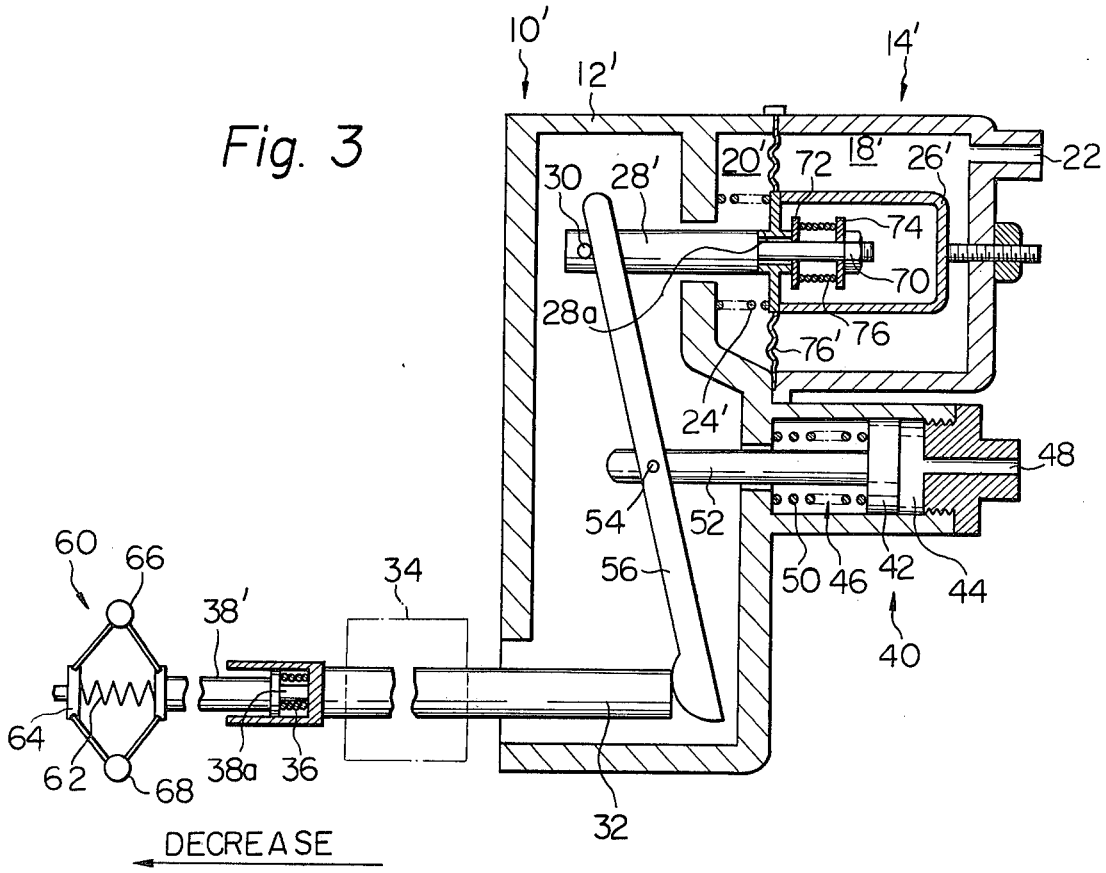
FIG. 3 is similar to FIG. 2 but shows the governor under low speed operating conditions.

A second embodiment of the governor of the present invention is shown in FIGS. 2 and 3 and designated as 10'. Since the governor 10' is identical to the governor 10 except for the addition of several elements, identical elements are designated by the same reference numerals as used in FIG. 1. Slightly modified elements which provide essentially the same function are designated by the same reference numerals as in FIG. 1 suffixed with an apostrophe.

In FIG. 2, a rod 38' is not fixed as is the rod 38 of FIG. 1 but is rotatable and movable left and right. A flyweight assembly 60 comprises an idling compression spring 62 disposed between the left end of the rod 38' and an input shaft 64, which urges the rod 38' rightwardly. Flyweights 66 and 68 are connected between the rod 38' and the input shaft 64 so as to urge the rod 38' leftwardly as the engine speed increases. The input shaft 64 is rotatably drivingly connected to a camshaft (not shown) of the fuel injection pump so as to be rotated at a speed proportional to the engine speed. The rod 38' is further provided with a stop **38*a* which is abuttable against the left end of the control rack 32 when the spring 36 is fully compressed. The rod 38' is rotatable with the input shaft 64 and flyweights 66 and 68 and movable right and left by the flyweights 66 and 68** as a function of the engine speed.

A boost compensator 14' is similar to the boost compensator 14 of FIG. 1 but comprises additional elements. A stop 26' serves the same function as the stop 26 but is cup-shaped. A nut 70 is fixed to an end of a rod 28' which passes through a diaphragm 16'. A releasing spring 76 is compressed between spring seats 72 and 74 to urge the spring seat 72 against the diaphragm 16 and the spring seat 74 against the nut 70. The force of the spring 76 urges the rod 28' rightwardly relative to the diaphragm 16' so that a shoulder **28*a* of the rod 28' is urged into abutment with the diaphragm 16'. In this manner, the rod 28' and diaphragm 16' are normally connected together for unitary movement. The flyweight assembly 60** is also provided with a governor spring which is not shown.

The operation of the governor 10' will now be described with reference to FIGS. 2, 3, 5, 6 and 7. It is assumed in the governor 10' that preloads F24', F62, F76 and F36 of the springs 24', 62, 76 and 36 respectively satisfy the relationship F24'>F62>F76>F36.

Figure 6:
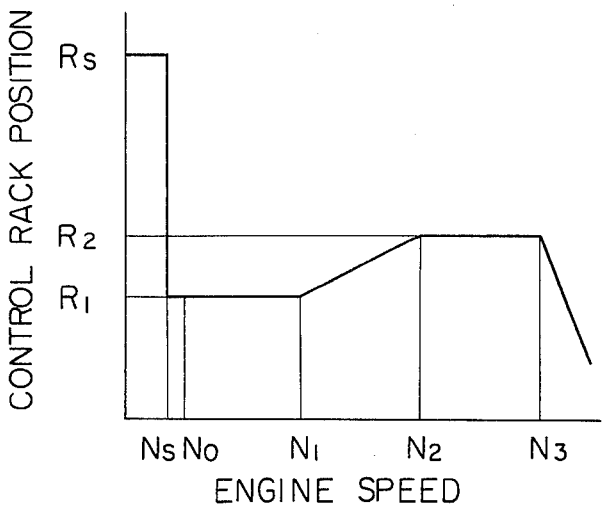

FIG. 6 illustrates a simplified case. The preload of the diaphragm spring 76 is set so that sufficient air pressure is present in the air chamber 18' to overcome the preload of the spring 24' at an engine speed N1. Below the engine speed N1 the control rack 32 is in a position R1 producing a fuel injection volume Q2. Between engine speeds N1 and N2 the control rack 32 is moved rightwardly to increase the fuel injection volume in a generally linear manner by the diaphragm 16' as the induction air pressure increases. At the engine speed N2 the spring 24' is compressed to a maximum extent and there is no change in the position of the control rack 32 until the engine speed rises to a design speed of N3. At the speed N3 the flyweights 66 and 68 begin to expand against the force of the governor spring (not shown) so that the fuel control rod 32 is moved leftwardly to decrease the fuel injection volume at engine speeds greater than N3.

The action of the oil pressure sensor 40 is also illustrated in FIG. 6 in that the fuel injection volume is increased to the maximum value Qs since the piston 42 moves the control rack 32 to maximum fuel position Rs at the engine speed Ns. It will be noted in FIG. 6 that no provision is made to increase the fuel injection volume at engine speeds between Ns and N1 to prevent stalling of the engine under heavy load when the engine speed drops into this range.

Figure 7:
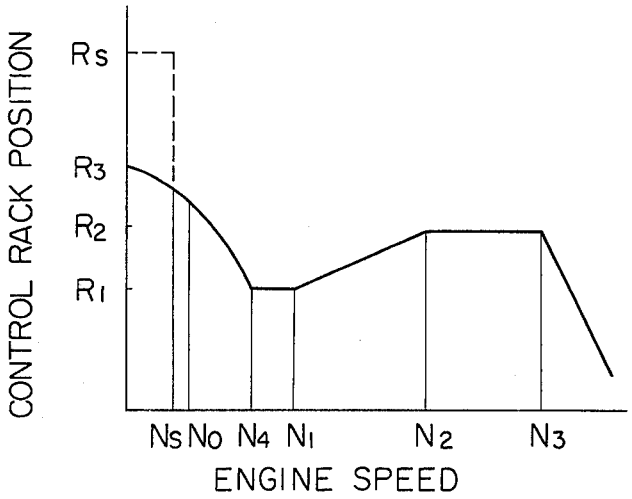

Referring now to FIG. 7, the operation of the complete governor 10' is illustrated. The operation of the governor 10' without the oil pressure sensor 40 is illustrated in solid line and the operation with the oil pressure sensor 40 provided is illustrated in phantom line. Neglecting temporarily the action of the oil pressure sensor 40, the idling spring 62 moves the rod 38' rightwardly against the force of the spring 36 at zero engine speed so that the stop **38*a* abuts against the control rack 32 and the idling spring 62 moves the control rack 32 rightwardly to a position R3 as shown in FIG. 3. As the engine speed increases, the flyweights 66 and 68 move the rod 38' leftwardly against the force of the idling spring 62. The control rack 32 is also moved leftwardly decreasing the fuel injection volume until the position R1 is reached at an engine speed N4 where the stop 38*a* disengages from the control rack 32 for a reason which will be described below. The action of the oil pressure sensor 40 is shown in phantom line such that in the complete governor 10' the control rack 32 does not reach the position R3 at zero engine speed but is moved to the maximum fuel injection position Rs at engine speeds below Ns by the oil pressure sensor 40**.

It will be noted that the operation of the idling spring 62 terminates at engine speeds above N4 and that the operation of the boost compensator 14' begins at the engine speed N1 which is higher than N4. Operation of the governor 10' at engine speeds above N4 is illustrated in FIG. 2. Without the provision of the releasing spring 76, rightward movement of the control rack 32 would pivot the lever 56 counterclockwise moving the pin 30, rod 28' and diaphragm 16' leftwardly thereby compressing the diaphragm spring 24'. The flyweights 66 and 68 would have to move against the combined forces of the idling spring 62 and the diaphragm spring 24', thereby producing an undesirable interaction between the flyweight assembly 60 and the boost compensator 14' by moving the diaphragm 16'.

The releasing spring 76 has a preload smaller than either the idling spring 62 or the diaphragm spring 24', so that leftward movement of the rod 28' by the lever 56 causes the spring 76 to be compressed. The rod 28' therefore moves leftwardly against the force of the weaker spring 76 relative to the diaphragm 16' while the diaphragm 16' remains in abutment with the stop 26' due to the force of the spring 24'. In this manner, the flyweight assembly 60 is decoupled from the boost compensator 14' at engine speeds lower than N4, and the governor 10' provides a fuel injection volume at all engine speeds and load conditions which is extremely close to optimum.

Many modifications within the scope of the present invention will become possible for those skilled in the art after receiving the teachings of the present disclosure.

What is claimed is:

1. An engine fuel injection pump governor comprising in combination:

a fuel injection control member movable from a maximum fuel injection position in a fuel injection decreasing direction;

biasing means urging the control member toward the maximum fuel injection position;

an engine induction air pressure sensor;

a linkage connecting the air pressure sensor to the control member in such a manner that the control member is moved thereby in a fuel injection increasing direction as a magnitude of sensed induction air pressure increases;

an engine oil pressure sensor connected to the linkage in such a manner that the control member is moved thereby to the maximum fuel injection position when a sensed engine oil pressure is substantially zero and is moved thereby in the fuel injection decreasing direction as the engine oil pressure increases;

an engine speed sensor for moving the control member toward the maximum fuel injection position as a sensed engine speed decreases below a predetermined value; and releasing means for allowing the control member to be moved by the speed sensor against the action of the air pressure sensor;

said air pressure sensor comprising a rod movable in response to sensed induction air pressure, the oil pressure sensor comprising a rod movable in response to sensed oil pressure and the linkage comprising a lever pivotally supported at an intermediate point thereof by the rod of the oil pressure sensor and pivotally engageable at its opposite end portions with the rod of the air pressure sensor and with the control member respectively.

2. A governor as in claim 1, in which the air pressure sensor comprises a diaphragm connected to the rod of the air pressure sensor for unitary movement and the oil pressure sensor comprises a piston connected to the rod of the oil pressure sensor for unitary movement.

3. A governor as in claim 1, in which the engine speed sensor comprises a flyweight assembly.

4. An engine fuel injection pump governor comprising in combination:

a fuel injection control member movable from a maximum fuel injection position in a fuel injection decreasing direction;

biasing means urging the control member toward the maximum fuel injection position;

an engine induction air pressure sensor;

a linkage connecting the air pressure sensor to the control member in such a manner that the control member is moved thereby in a fuel injection increasing direction as a magnitude of sensed induction air pressure increases;

an engine oil pressure sensor connected to the linkage in such a manner that the control member is moved thereby to the maximum fuel injection position when a sensed engine oil pressure is substantially zero and is moved thereby in the fuel injection decreasing direction as the engine oil pressure increases;

an engine speed sensor for moving the control member toward the maximum fuel injection position as a sensed engine speed decreases below a predetermined value; and releasing means for allowing the control member to be moved by the speed sensor against the action of the air pressure sensor;

said air pressure sensor comprising a diaphragm, a rod movable with the diaphragm and a diaphragm spring urging the diaphragm against induction air pressure, the linkage pivotally engaging with the rod, the releasing means comprising a releasing spring urging the rod toward abutting engagement with the diaphragm for unitary movement therewith, the releasing spring yielding in response to movement of the control member and the linkage by the speed sensor so that the rod is moved relative to the diaphragm by the linkage.

5. A governor as in claim 4, in which the linkage comprises a lever pivotally supported by the oil pressure sensor at an intermediate point thereof and a pin fixed to the rod of the oil pressure sensor, the lever being urged by the speed sensor to abuttingly engage with the pin and with the control member.

* * * * *